United States Patent [19]

Schimmel

[11] 4,433,826

[45] Feb. 28, 1984

[54] ADJUSTABLE LONG BOLT

[75] Inventor: Vernon R. Schimmel, Lincolnwood, Ill.

[73] Assignee: Symons Corporation, Des Plaines, Ill.

[21] Appl. No.: 305,396

[22] Filed: Sep. 25, 1981

[51] Int. Cl.[3] ..... E04G 17/06

[52] U.S. Cl. ..... 249/38; 249/165; 249/166; 249/191; 249/216; 249/217

[58] Field of Search ..... 249/38, 165, 166, 191, 249/216, 217

[56] References Cited

U.S. PATENT DOCUMENTS

| | | | |
|---|---|---|---|
| 2,948,045 | 8/1960 | Imonetti | 249/217 |
| 3,137,909 | 6/1964 | Bonin | 249/191 |
| 3,414,230 | 12/1968 | Brosseau | 249/193 |
| 3,643,909 | 2/1972 | Brosseau | 249/217 |
| 4,210,306 | 7/1980 | Schimmel | 249/216 |

FOREIGN PATENT DOCUMENTS

| | | | |
|---|---|---|---|
| 572626 | 3/1959 | Canada | 249/191 |

*Primary Examiner*—John A. Parrish

*Attorney, Agent, or Firm*—Hill, Van Santen, Steadman & Simpson

[57] ABSTRACT

An adjustable long bolt for connecting modular concrete form panels. The bolt is generally flat along its length and has a pair of elongated slots disposed in adjacency to opposite ends of the bolt. At least one circular hole is disposed between the slots having its mid-point disposed along a longitudinal line in longitudinal alignment with longitudinal axes of said elongated slots. The longitudinal spacing between the elongated slots with respect to the at least one circular hole being varied to enable the bolt to be installed in a larger number of adjustable positions by turning the bolt on its end through an arc of rotation of 180°.

18 Claims, 7 Drawing Figures

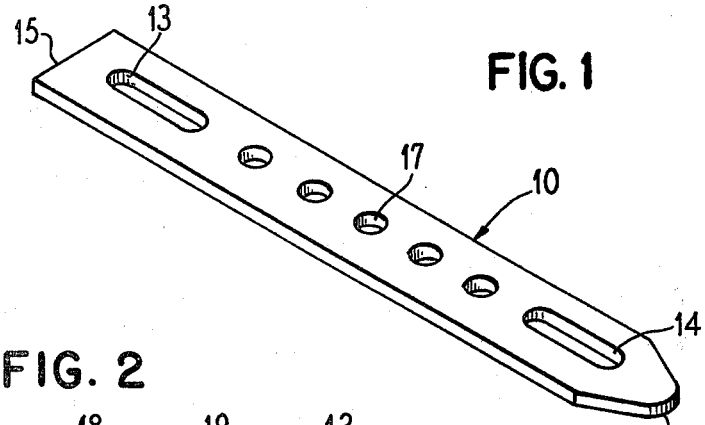
FIG. 1
FIG. 2
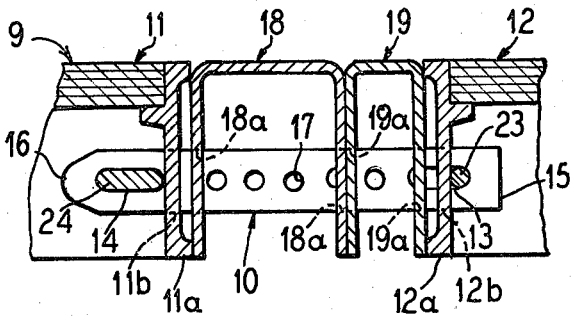
FIG. 6
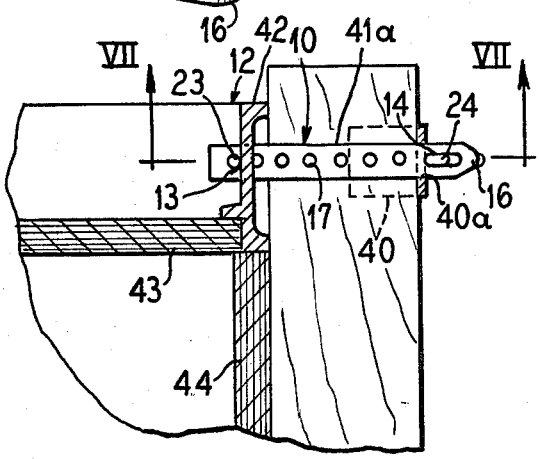
FIG. 3
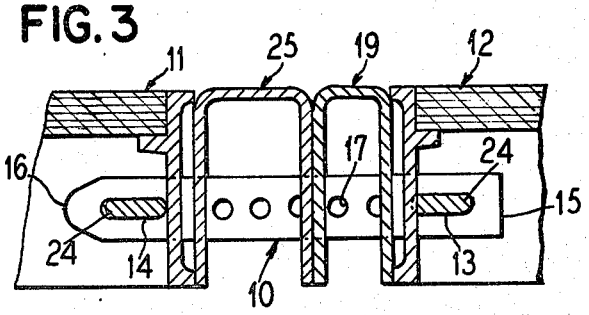
FIG. 7
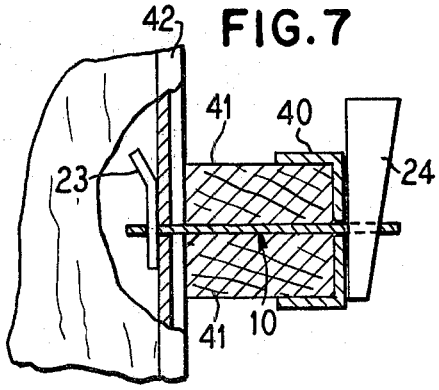
FIG. 4
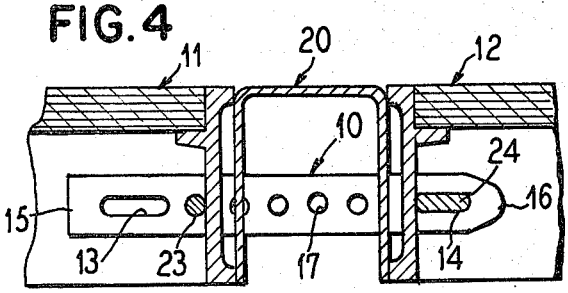
FIG. 5
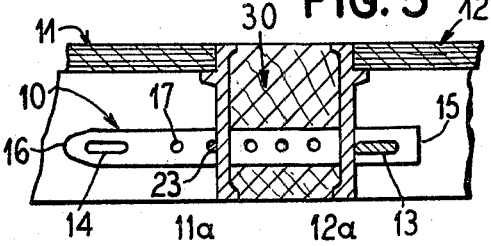

ADJUSTABLE LONG BOLT

FIELD OF THE INVENTION

This invention relates to an adjustable long bolt for connecting modular concrete form panels either directly together or in assembly with one or more fillers positioned between the panels in the set-up of a modular concrete form structure.

BACKGROUND OF THE INVENTION

Adjustable long bolts have been in use for many years. During the last twenty-five years or so a so-called T-shaped connecting bolt has been used. This bolt has an enlarged T-shaped head at one end and opposite end of the bolt is pointed. Along the shank of the bolt between the ends are a pair of holes and an elongated slot with the slot being positioned in closest adjacency to the pointed end. This type of prior art bolt has a number of disadvantages as compared to the improved adjustable long bolt herein disclosed. The prior art bolt T-head acts as a T-square and prevents the bolt shank for assuming a compromise angle relative to the angle between adjoining siderails. This condition either shortens the usable grip length of the bolt or an all steel filler must add its dimension to one adjoining panel thereby increasing the mid-ordinate dimension. Particularly in 2" filler installations, the bolt is forced to T-square because the normal minimal wedge bolts grip tolerance available requires excessive securement of the wedge-bolt. Still further, the new adjustable long bolt herein disclosed has a number of important advantages that are unattainable by the old prior art bolts of the type under consideration.

According to important features of my invention, I have provided a new and improved adjustable long bolt for connecting modular concrete form panels. The bolt is generally flat along its length and has a pair of elongated slots disposed in adjacency to opposite ends of the bolt and at least one circular hole is disposed between the slots. The circular hole or holes preferably has its mid-point or mid-points disposed along a longitudinal line in longitudinal alignment with longitudinal axes of said elongated slots. The longitudinal spacing between the slots with respect to the at least one circular hole is varied to enable the bolt to be installed in a larger number of adjustable positions by turning the bolt on its end through an arc of rotation of 180°.

In the prefererred embodiment of my invention, the adustable long bolt is provided with five holes and the holes are equidistantly spaced apart along the length of the bolt and are all located between the elongated slots.

According to other features of my invention, the enlarged head has been eliminated and my adjustable long bolt is headless or squared-off at one end and pointed at an opposite end.

With a new and improved adjustable long bolt of the type generally described so far, a number of advantages are attainable. To this end, the adjustable long bolt can be infinitely adjusted 0–2¼" plus a 2½" to 3½" adjustment range. Further, my new bolt has a means to fine tune adjust English dimensions to metric (0 to 60 mm).

According to other features of my invention a modular concrete form structure has been provided which includes a pair of concrete form panels to be joined together. Each pair has confronting slotted panel margins. According to my invention, an improved adjustable long bolt is provided for coaction with the slotted panel margins and the bolt is extensible into the slots on the panels for connecting the pair of the modular concrete panels together. The bolt is generally flat along its length. A pair of elongated slots are disposed in adjacency to opposite ends of the bolt and at least one circular hole is disposed between the slots having its mid-point disposed along a longitudinal line in longitudinal alignment with longitudinal axes of the elongated slots. The longitudinal spacing between said slots with respect to the at least one circular hole is varied to enable the bolt to be installed in a larger number of adjustable positions by turning the bolt on its end through an arc of rotation of 180°. A connecting wire tie is provided for insertion into one of the slots adjacent one end of the bolt. A wedge bolt is provided for insertion through an elongated slot at an opposite end of the bolt thus serving to tie the panels in snug wedged assembly together.

In view of the foregoing, it will be appreciated that it is an important object of this invention to provide a new and improved adjustable long bolt that can be used in combination with modular concrete form panels to provide an increased variety of adjustments to enable the bolt to be used in greater numbers of arrangements as compared with any previously known bolt of this type.

Still another object of this invention is to provide a new and improved adjustable long bolt that can adjust concrete form panels with or without fillers to English dimensions and to metric dimensions.

A more specific object of this invention is to provide a new and improved adjustable long bolt that provides infinite adjustment 0 to 2½" plus a 2½" to 3½" adjustment range.

Still another and further object of the present invention is to provide an adjustable long bolt that can adjust for optimum grip of standard fin-less filler on radius walls, particularly the small diameters.

Another object of the invention is to provide a new and improved adjustable long bolt that can adjust to optimum grip of any job-built wood filler. A still further object of the invention is to provide a new and improved headless adjustable long bolt that can be stripped from assembly with modular concrete form panels in tight quarters in either direction.

Other objects and features of the present invention will more fully become apparent in view of the following detailed description taken in conjunction with the accompanying drawings illustrating the invention as follows:

FIG. 1 is a perspective view of an adjustable long bolt embodying important features of my invention;

FIG. 2 is a fragmentary cross-sectional view with parts shown in elevation illustrating how an adjustable long bolt can be mounted in assembly with a modular concrete form structure;

FIG. 3 is a fragmentary cross-sectional view similar to FIG. 2 only illustrating the long bolt being held in position with a modular concrete form structure by means of a pair of wedge bolts;

FIG. 4 is a fragmentary cross-section similar to FIGS. 2 and 3 only showing a pair of panels mounted in assembly with only a single filler and with the long bolt being rotated 180° to enable the bolt to be secured in assembly when the dimensional relationships of the modular concrete form structure are varied;

FIG. 5 is a fragmentary cross-sectional view similar to FIG. 4 only illustrating the adjustable long bolt being used for the securement of a solid wood filler that can be suppled from the field;

FIG. 6 is a fragmentary partially sectioned view showing my adjustable long bolt mounted in assembly with a modified type of modular conccrete form structure; and FIG. 7 is an enlarged fragmentary cross-sectional view taken substantially on line VII—VII looking in the direction indicated by the arrow.

DESCRIPTION OF AN EXEMPLARY EMBODIMENT

The reference numeral 10 indicates generally an adjustable long bolt embodying important features of this invention. The long bolt 10 is adapted for coaction with a modular concrete form structure 9 that includes a pair of concrete form panels 11 and 12 which are to be joined together. In the past, other types of connecting bolts have been used for the purpose of joining panels of the same type shown in FIG. 2. The long bolt herein disclosed is believed to be an inventive improvement thereover in view of its new and improved construction and the many advantages that are obtainable as a consequence of the new construction feature.

The adjustable long bolt 10 includes a pair of elongated slots 13 and 14 which are positioned in adjacency to opposite ends 15 and 16 of the bolt. The slots are shown to be in an elliptical shape but could be rectangularly shaped and still function in a satisfactory manner. One of the opposite ends is of a squared-off shape and the other end is of a tapered or pointed shape. The squared-off shape differs from the connecting bolts that have been previously known to the applicant insofar as the bolts used before had a T-shaped end and it is believed that the modification of this shape to provide the bolt with a squared-off headless end 15 is a distinct improvement and enables the bolt to be more vesatilely used, particularly where at least one circular hole 17 is disposed between the elongated slots 13 and 14 and where the spacing between the circular hole 17 and the elongated slot 13 is different than the spacing between the circular hole and the elongated slot 14. By having this unique spacing feature, the bolt can be installed in a larger number of adjustable positions by turning the bolt on its end through an arc of rotation of 180°. FIGS. 2 and 4 show contrasting ways in which the bolt can be secured in position with the same concrete form panels 11 and 12. The reasons why this feature is important is that with one type of modular concrete form structure it may be necessary to install a pair of U-shaped fillers 18 and 19 (FIG. 2) with another type of modular concrete form structure it may be necessary to use still a third type of filler 20 which may have a different dimension than the fillers 18 and 19 together and/or singularly.

It will further be seen that in the preferred embodiment, that the hole 17 has its mid-point disposed along a longitudinal line in longitudinal alignment with longitudinal axes of the elongated slots 13 and 14. It is conceivable that the holes 17 could be positioned off-line with respect to the longitudinal axes of the elongated slots so that the purposes of the present invention could be carried out but where it is desired to maintain the width of the bolt as narrow as possible, it is the preferred construction to dispose the hole 17 in alignment with the slots 13 and 14 as illustrated in FIG. 1 and elsewhere in the drawings.

It will further be appreciated that in the preferred construction of the adjustable long bolt that the circular holes 17, number five in total, with the hole 17 being equidistantly spaced along the length of the bolt. These holes 17 have centerpoints which are spaced one half inch apart along the length of the bolt.

The elongated slots 13 and 14 are each preferably $\frac{7}{8}''$ long and $\frac{1}{4}''$ wide. The right-hand edge of the slot 13 closest to the hole 17 is $\frac{1}{2}''$ away from the edge of the hole 17. Each of the holes 17 are $\frac{1}{4}''$ in diameter. The elongated slot 14 has its nearest edge $\frac{1}{4}''$ away from the nearest hole 17. Thus, the spacing between the elongated slots 13 and 14 with respect to the nearest adjacent holes is different in that one spacing is $\frac{1}{2}''$ and the other is $\frac{1}{4}''$. By arranging the slots with respect to the holes 17 in this way the adjustable long bolt can be made more versatile in its usage with the concrete form panels 11 and 12. It will further be appreciated that while the holes are shown as being spaced $\frac{1}{2}''$ apart this spacing could be $\frac{5}{8}''$ if desired. Still further, while the holes 17 are each constructed so as to have a $\frac{1}{4}''$ diameter this diameter could be also varied to meet other specifications without departing from the inventive features of my invention. The $\frac{1}{4}''$ hole 17 is satisfactory to operate with a 20 penny nail or a 0.225" diameter tie wire 23 or a 0.245" diameter tie wire.

INSTALLATION

The tapered ends 16 of each adjustable long bolt 10 must point to the same left or right direction at each fill-in joint between panels 11 and 12.

The selection of the correct short stop hole 17 and the correct end of wedge-bolt slots 13 and 14 can be determined in a very few seconds. If desired, the pointed end could be color-coated instead of being tapered or pointed and the alignment of the adjustable long bolts relative to one another could be then easily determined without referring to the tapered end construction.

In addition to the foregoing, it is also possible that the adjustable long bolt could be of a tapered construction with the narrowest thickness of the bolt being at the tapered end 16 and with the widest section of the bolt being at the squared-off end 15 of the bolt.

As mentioned before, where it is desired to install the adjustable long bolt, the tapered end 16 of the bolt can be passed through panel side rails **11*a* and 12*a* and more particularly through panel side rail slots 11*b* and 12*b*. Also, the adjustable long bolt would pass through filler slots 18*a*—18*a* and 19*a*—19*a*. The short stop pin or tie wire 23 can then be installed and a wedge bolt 24** can be hammered in place to lock the components in assembled relation all as shown in FIG. 2.

The modular concrete form structure shown in FIG. 3 is slightly different in that a filler 25 is provided in combination with the filler 19 and it will be seen that the filler 25 has a different width than the filler 18. To allow for this variation, a second wedge bolt 24 is substituted in place of the wire tire or short stop 23.

As stated before, FIG. 4 illustrates a modified arrangement where only single filler 20 is employed and this filler is identical in width to the filler 18. Here, the adjustable long bolt 10 can be moved through an arc of 180° and the short stop tie wire 23 can be installed with the wedge bolt 24 to effect assembly of the component since the filler 30 is of a 2" size, a short stop or wire tie 23 in the last round hole 17 passing through the connector provides improved wedge-bolt grip through a 2" filler. Since all round holes are spaced $\frac{1}{2}''$ O.C., a short stop in the second of the last hole provides improved grip through 1½" filler. A short stop in the third hole provides substantial better grip through a 1" filler. The remaining two holes and the wedge slot at the square end are only utilized to gain infinite adjustability from 0 to 2½" plus a 2½" to 3½" adjustment range.

In FIG. 5, the modular concrete form structure contemplates the use of a different type of a filler. In this instance, a wood filler 30 is employed. The solid wood filler 30 can be supplied in the field. The solid wood filler can be assembled with the panel side rails 11*a* and 12*a* in the same way as previously described through the use of a tie wire 23 and a wedge bolt 24.

In FIGS. 6 and 7 the adjustable long bolt 10 is shown in a slightly different arrangement for use with a modular concrete form structure 9'. Here, a U-shaped waler plate 40 is shown mounted upon a double 2×4 lumber or prop 41. As shown in FIG. 6, the adjustable long bolt 10 extends through a panel side rail 42 carried on a panel 43. The bolt then passes through a gap 41*a* between the double 2×4 lumber pieces 41, 41 and also through a hole 40*a* in the waler plate as is illustrated. Wire tie 23 and a wedge plate 24 are used to secure the solid wood filler and its waler plate in assembly with the panel side rail 42 in the same manner as previously discussed. The prop 41 serves to support a second panel 44 at its opposite ends and along its length. It will be appreciated that only one end of the prop 41 is shown as being secured to a panel side rail 42. The opposite end of the prop not shown is attached to a second panel like panel 43 in an identical manner for supporting the panel 44. The second panel 44 is in this manner mounted in angled relation to the panel 43.

Application Advantages

1. Provide infinite adjustment 0 to 2½" plus a 2½" to 3½" adjustment range.
2. Provide means to fine tune adjust English dimensions to metric (0 to 60 mm).
3. They adjust for optimum grip of standard fin-less filler on radius walls, particularly the smaller diameters.
4. Will adjust to optimum grip of any job-built wood filler.
5. Will serve as a substitute 30" Column Form special length wedge-bolt, or any other accessory attachment that requires an extended standard wedge bolt grip.
6. Will provide optimum grip for attaching timber bulk-head support bars.
7. Can be stripped in tight quarters in either direction.
8. The adjustable long bolt will grip a 2½" dimension by utilizing a wedge bolt in each end slot. This enables a 1½" plus a 1" all steel filler to be installed at the same panel point, thereby eliminating the extra cost of short stopping long connecting bolts at two separate panel joints.
9. With a short-stop (broken tie end) in one end slot it will provide a 3" grip through a 2" plus a 1" all steel filler.
10. On average radius curved walls the angle created between siderails at either side of an all steel filler increases the required long bolt grip length ⅛" or more. There is not a way to compensate for grip variation using the present long bolts, and in many applications the locking wedge bolt does not have sufficient engagement and could vibrate out. With the adjustable bolt it is possible to select the correct short-stop hole which will put the wedge-bolt at its optimum grip depth.

Present Long Connecting Bolt Disadvantages

1. On curved walls the long connecting bolt T-head acts as a T-square and prevents the bolt shank from assuming a compromise angle relative to the angle between adjoining siderails. This condition either shortens the usable grip length of the bolt or the all steel filler must add its dimension to one adjoining panel thereby increasing the mid-ordinate dimension. Particularly in 2" filler installations the bolt is forced to T-square because the normal minimal wedge bolt grip tolerance available requires excessive tighten of the wedge-bolt.
2. Its greatest disadvantage is that it can't perform the added application advantages of the adjustable long bolt listed hereafter.

Additional Performance Features

1. With a wedge-bolt in each end slot it will provide a 2½" grip through a 1½" plus a 1" all steel filler. This eliminates extra cost of short-stopping long connecting bolts at two separate panel joints.
2. With a short-stop (broken tie end) in one end slot it will provide a 3" grip through a 2" plus a 1" all steel filler.
3. On average radius curved walls the angle created between siderails at either side of an all steel filler increases the required long bolt grip length ⅛" or more. There is not a way to compensate for grip variation using the present long bolts, and in many applications the locking wedge bolt ends up with a very shallow grip. With the adjustable bolt it is possible to select the correct short-stop hole which will put the wedge-bolt at its optimum grip depth.

I claim:

1. In a modular concrete form structure including a concrete form panel and a second panel mounted in angled relation which panels are to be supported together by a prop, the improvement of an adjustable long bolt extendable into slots in the panel and the prop for connecting them together; another of the panels being supported by the prop, the bolt being generally flat along its length, a pair of elongated slots disposed in adjacency to opposite ends of the bolt and at least one circular hole disposed between the slots having its midpoint disposed along a longitudinal line in longitudinal alignment with longitudinal axes of said elongated slots, the longitudinal spacing between said slots with respect to said at least one circular hole being varied to enable the bolt to be installed in a larger number of adjustable positions by turning the bolt on its end through an arc of rotation of 180°, a slotted waler plate carried on the prop with the bolt extended therethrough, a connecting wire tie for insertion into one of said slots adjacent one end of said bolt, and a wedge bolt for insertion through an elongated slot at an opposite end of said bolt thus serving to tie the panels and the waler plate in snug wedged assembly together, the bolt being headless and being hammerable from either end to effect assembly or disassembly from said slotted waler plate.

2. The structure of claim 1 further characterized by the elongated slots being elliptical in shape.

3. The structure of claim 1 characterized by one headless end of the long bolt being tapered and its opposite end being of a squared-off shape.

4. The structure of claim 1 further characterized by the at least one circular hole numbering five holes and with the holes being equidistantly spaced apart along the length of the bolt.

5. The structure of claim 1 further characterized by including five circular holes disposed between said slots and with the holes having center points which are spaced one half inch apart along the length of the bolt.

6. The structure of claim 1 further characterized by including five circular holes disposed between said slots and with the holes having center points which are spaced one half inch apart along the length of the bolt, one of the elongated slots being spaced one half inch from the nearest associated one of said circular holes and the other of the elongated slots being spaced one fourth inch from the nearest one of the associated circular holes.

7. The structure of claim 1 further characterized by the bolt having a pointed end at one end and being headless at its opposite end and being of a tapered thickness along its length to facilitate insertion and removal of the bolt with respect to an associated slot on a concrete panel to which the bolt is to be connected, the pointed end having a thinner thickness than the headless end.

8. The structure of claim 1 further characterized by a slotted filler being mounted between the confronting slotted panel margins and with the long bolt extending through the slotted filler and the panel margins, the holes on the long bolt serving to provide means including short stops locking one or more variable width fillers in assembly with said panel margins.

9. The structure of claim 1 further characterized by a pair of slotted fillers having varying widths positioned between the confronting slotted panel margins and with the long bolt extending through the slotted filler and the panel margins, the holes on the long bolt providing means which includes a short stop cooperable with either a hole or an elongated slot and a wedge bolt to secure the panel margins and the fillers of varying widths in unitary assembly.

10. The structure of claim 1 further characterized by the prop comprising a pair of 2×4 lumber pieces held together by said slotted waler plate and with said bolt extending between said lumber pieces and through said slotted plate.

11. In a modular concrete form structure including a pair of concrete form panels to be joined together, each having confronting slotted panel margins, the improvement of an adjustable long bolt extendable into confronting slots on the panels for connecting a pair of the modular concrete form panels together, the bolt being generally flat along its length, a pair of elongated slots disposed in adjacency to opposite ends of the bolt and at least one circular hole disposed between the slots having its mid-point disposed along a longitudinal line in longitudinal alignment with longitudinal axes of said elongated slots, the longitudinal spacing between said slots with respect to said at least one circular hole being varied to enable the bolt to be installed in a larger number of adjustable positions by turning the bolt on its end through an arc of rotation of 180°, a connecting wire tie for insertion into one of said slots adjacent one end of said bolt, and a wedge bolt for insertion through an elongated slot at an opposite end of said bolt thus serving to tie the panels in snug wedged assembly together, the bolt being headless and being hammerable from either end to effect assembly or disassembly from said slotted waler plate.

12. The structure of claim 11 characterized by one end of the long bolt being tapered and its opposite headless end being of a squared-off shape.

13. The structure of claim 11 further characterized by the at least one circular hole numbering five holes and with the holes being equidistantly spaced apart along the length of the bolt.

14. The structure of claim 11 further characterized by including five circular holes disposed between said slots and with the holes having center points which are spaced one half inch apart along the length of the bolt.

15. The structure of claim 11 further characterized by including five circular holes disposed between said slots and with the holes having center points which are spaced one half inch apart along the length of the bolt, one of the elongated slots being spaced one half inch from the nearest associated one of said circular holes and the other of the elongated slots being spaced one fourth inch from the nearest one of the associated circular holes.

16. An adjustable long bolt for connecting modular concrete form panels, the bolt being headless at one end, pointed at an opposite end, and being generally flat along its length, a pair of elongated slots disposed in adjacency to opposite ends of the bolt and at least one circular hole disposed between the slots the longitudinal spacing between said slots with respect to said at least one circular hole being varied to enable the bolt to be installed in a larger number of adjustable positions by turning the bolt on its end through an arc of rotation of 180°.

17. A headless parallel-edged adjustable long bolt for connecting modular concrete form panels, the bolt being generally flat along its length; a pair of elongated slots disposed in adjacency to opposite ends of the bolt and a plurality of circular holes uniformly spaced in a row relative to one another, the holes all being disposed between the slots and each having its mid-point disposed along a longitudinal line in longitudinal alignment with longitudinal axes of said elongated slots, the longitudinal spacing between said holes at opposite ends of the row with respect to the closest adjacent one of the elongate slots being varied to enable the bolt to be installed in a larger number of adjustable positions by turning the bolt on its end through an arc of rotation of 180°.

18. The adjustable long bolt of claim 17 further characterized by including five circular holes disposed in a row between said slots and with the holes having center points which are spaced one half inch apart along the length of the bolt, one of the elongated slots being spaced one half inch from the nearest associated one of said circular holes and the other of the elongated slots being spaced one fourth inch from the nearest one of the associated circular holes.

* * * * *

UNITED STATES PATENT OFFICE
CERTIFICATE OF CORRECTION

PATENT NO. : 4,433,826
DATED : February 28, 1984
INVENTOR(S) : Vernon Richard Schimmel It is certified that error appears in the above-identified patent and that said Letters Patent are hereby corrected as shown below:

Column 1, line 15 insert between "and" and "opposite" the word -- the --.

Column 1, line 22 "for" should be -- from --.

Column 3, line 38 "vesatilely" should be -- versatilely --.

Signed and Sealed this

*Seventh* Day of *August 1984*

[SEAL]

*Attest:*

GERALD J. MOSSINGHOFF

*Attesting Officer*

*Commissioner of Patents and Trademarks*